US009508519B2

(12) United States Patent
Jung et al.

(10) Patent No.: US 9,508,519 B2
(45) Date of Patent: Nov. 29, 2016

(54) FUSE AND MANUFACTURING METHOD THEREOF

(71) Applicant: SMART ELECTRONICS INC., Ulsan (KR)

(72) Inventors: Jong il Jung, Busan (KR); Doo Won Kang, Anyang-si (KR); Gyu Jin Ahn, Ulsan (KR); Sang Joon Jin, Busan (KR); Hyun Chang Kim, Ulsan (KR); Kyung Mi Lee, Ulsan (KR); Kwang Beom Kim, Yangsan-si (KR); So Young Kim, Ulsan (KR)

(73) Assignee: SMART ELECTRONICS INC., Ulsan (KR)

( * ) Notice: Subject to any disclaimer, the term of this patent is extended or adjusted under 35 U.S.C. 154(b) by 0 days.

(21) Appl. No.: 14/441,839

(22) PCT Filed: Nov. 6, 2013

(86) PCT No.: PCT/KR2013/010032

§ 371 (c)(1),
(2) Date: May 9, 2015

(87) PCT Pub. No.: WO2014/073862

PCT Pub. Date: May 15, 2014

(65) Prior Publication Data

US 2015/0279605 A1 Oct. 1, 2015

(30) Foreign Application Priority Data

Nov. 9, 2012 (KR) ..... 10-2012-0126417

(51) Int. Cl.
*H01H 85/143* (2006.01)
*H01H 85/175* (2006.01)

(Continued)

(52) U.S. Cl.
CPC ..... *H01H 85/143* (2013.01); *H01H 69/02* (2013.01); *H01H 85/17* (2013.01); *H01H 85/175* (2013.01); *H01H 85/185* (2013.01); *H01H 85/0026* (2013.01); *Y10T 29/49107* (2015.01)

(58) Field of Classification Search
CPC .... H01H 69/02; H01H 85/185; H01H 85/17; H01H 85/175; H01H 85/143; H01H 85/0026; Y10T 29/49107
USPC ..... 337/232
See application file for complete search history.

(56) References Cited

U.S. PATENT DOCUMENTS 3,156,801 A * 11/1964 Cole ..... H01H 85/143 337/161
4,540,969 A * 9/1985 Sugar ..... H01H 85/0458 337/228

(Continued)

FOREIGN PATENT DOCUMENTS

JP 2005-026036 A 1/2005
KR 1992-0007019 A 4/1992

(Continued)

*Primary Examiner* — Anatoly Vortman
(74) *Attorney, Agent, or Firm* — Novick, Kim & Lee, PLLC; Jae Youn Kim

(57) ABSTRACT

A fuse and a manufacturing method thereof are disclosed. Since a nonconductive member formed of a ceramic material with excellent mechanical strength and a ceramic tube are used and the ceramic tube is joined to sealing electrodes by use of brazing rings, durability of the fuse is considerably improved. The fuse may be stably used at a high voltage by improving time-lag characteristics.

13 Claims, 11 Drawing Sheets

(51) Int. Cl.

| | |
|---|---|
| ***H01H 69/02*** | (2006.01) |
| ***H01H 85/17*** | (2006.01) |
| ***H01H 85/18*** | (2006.01) |
| *H01H 85/00* | (2006.01) |

(56) References Cited

U.S. PATENT DOCUMENTS 4,703,300 A * 10/1987 Gaia ..... H01H 85/0458 337/163
5,812,046 A * 9/1998 Brown ..... H01H 85/0411 29/623
5,994,994 A * 11/1999 Ito ..... H01H 85/0418 337/228
6,147,585 A * 11/2000 Kalra ..... H01H 85/0411 29/623
6,552,646 B1 * 4/2003 Wong ..... H01H 85/143 337/231
6,778,061 B2 * 8/2004 Nakano ..... H01H 85/157 337/186
7,320,171 B2 * 1/2008 Jollenbeck ..... H01H 85/0418 29/623
8,154,376 B2 * 4/2012 Aberin ..... H01H 69/02 29/623
2015/0287505 A1 * 10/2015 Jung ..... H01C 17/02 338/272
2015/0303657 A1 * 10/2015 Jung ..... H01T 4/12 361/120

FOREIGN PATENT DOCUMENTS

KR 2001-0008916 A 2/2001
KR 2002-0078649 A 10/2002
KR 10-2004-0086885 A 10/2004

* cited by examiner

FUSE AND MANUFACTURING METHOD THEREOF

BACKGROUND OF THE INVENTION

Field of the Invention

The present invention relates to a fuse and a manufacturing method thereof, and more particularly, to a fuse having improved durability, since a nonconductive member formed of a ceramic material with excellent mechanical strength and a ceramic tube are used and the ceramic tube is joined to sealing electrodes by use of brazing rings, and stably used at a high voltage by improving time-lag characteristics, and a manufacturing method thereof.

Description of the Related Art

Generally, a fuse is used in electronic devices such as TVs, computers, cassette players, small electronic devices, and the like to protect a circuit and electronic components from overvoltage as a fusible element interrupts power when an overvoltage is applied thereto.

A fuse should not generate a large amount of heat and should not be blown out (cut off) under normal conditions even when a maximum rated voltage is applied thereto. The fuse should only be blown out under abnormal conditions. The fuse requires excellent time-lag characteristics so as not to be blown out at a transient high voltage such as a surge voltage.

A fuse disclosed in Korean Patent Application Publication No. 1992-0007019 (published on Apr. 28, 1992) is manufacturing by inserting a temporary tube having a bent portion at one end and including a filament into the center of a glass tube to interlock one end with a silicon creeper, aligning the filament in the glass tube by returning the temporary tube and temporarily aligning the filament in the glass tube to form a diagonal line by moving the filament contained in the glass tube, and applying metal caps provided with internal leads to both ends of the glass tube and soldering the metal caps to both ends of the temporarily aligned filament forming a diagonal line in the glass tube using a soldering iron.

However, the conventional fuse has poor durability since the glass tube is used and joining is performed by soldering. In addition, since the internal lead is inserted into the glass tube, the length of the filament is limited. Accordingly, sufficient time-lag for high voltage operation cannot be achieved.

SUMMARY OF THE INVENTION

Therefore, the present invention has been made in view of the above problems, and it is an object of the present invention to provide a fuse having improved durability since a nonconductive member formed of a ceramic material with excellent mechanical strength and a ceramic tube are used and the ceramic tube is joined to each of the sealing electrodes by use of brazing rings, and a method of manufacturing the fuse.

It is another object of the present invention to provide a fuse that is stably used at a high voltage by improving time-lag characteristics by winding a fusible element of a fuse unit on the outer circumferential surface of a nonconductive member to have sufficient length and a sufficient number of turns, and a method of manufacturing the fuse.

It is a further object of the present invention to provide a fuse capable of improving wetting properties and joining strength of brazing rings by forming a plating layer at brazing junction regions, and a method of manufacturing the fuse.

In accordance with the present invention, the above and other objects can be accomplished by the provision of a fuse including a ceramic tube, a pair of sealing electrodes disposed at both ends of the ceramic tube and respectively electrically connected to lead wires, a fuse unit accommodated in the ceramic tube to be electrically connected to the sealing electrodes and including a nonconductive member, terminal electrodes disposed at both ends of the nonconductive member, and a fusible element electrically connected to the terminal electrodes, and brazing rings sealing between the ceramic tube and each of the sealing electrodes. In this regard, the ceramic tube is joined to the sealing electrodes by melting of the brazing rings.

The nonconductive member may have a rod shape and may be formed of a ceramic material, and the fusible element may be wound on the outer circumferential surface of the nonconductive member.

The brazing ring may include an alloy including copper (Cu), silver (Ag), and zinc (Zn).

Each of the sealing electrodes may include a contact portion protruding toward the inside of the ceramic tube to be inserted into the ceramic tube and contact the fuse unit and a junction portion joined to the brazing ring.

An outer surface of the brazing ring may be disposed at the same line of an outer surface of the ceramic tube, and an inner surface of the brazing ring may be disposed to extend toward the inside of the ceramic tube to a portion farther inward than an inner edge of the ceramic tube.

The brazing ring may include an outer circumferential portion joined to the ceramic tube and an inner circumferential portion joined to an end portion of the fuse unit.

The fuse may further include brazing members melted between the contact portion and each of the terminal electrodes to join the contact portion to the terminal electrode.

The fuse may further include a plating layer including nickel (Ni) or titanium (Ti) disposed on at least one selected from the group consisting of the contact portion, the junction portion, and the terminal electrode to improve joining strength by melting of the brazing ring or the brazing member.

In accordance with an aspect of the present invention, the above and other objects can be accomplished by the provision of a method of manufacturing a fuse including preparing the first sealing electrode, sequentially stacking the first brazing ring and the ceramic tube on the first sealing electrode, inserting the fuse unit into the ceramic tube, sequentially stacking the second brazing ring and the second sealing electrode on the ceramic tube, and sealing between the ceramic tube and each of the first and second sealing electrodes by placing the resultant structure in a chamber and melting the first and second brazing rings. In this regard, the fuse includes a ceramic tube accommodating a fuse unit, first and second sealing electrodes disposed at both ends of the ceramic tube to be connected to the fuse unit, and first and second brazing rings sealing between the ceramic tube and each of the sealing electrodes.

Each of the first and second sealing electrodes may include a contact portion protruding toward the inside of the ceramic tube to be inserted into the ceramic tube and contact the fuse unit and a junction portion joined to each of the first and second brazing rings, and each of the first and second brazing rings may be inserted to the junction portion of each of the first and second sealing electrodes.

The first and second brazing rings may be formed of $Ag_{25}CuZnSn$, an alloy including silver (Ag), copper (Cu), zinc (Zn), and tin (Sn), and the sealing may be performed by melting the first and second brazing rings at a temperature of 500 to 850.

A plating layer including nickel (Ni) or titanium (Ti) may further be disposed on the surface of the junction portion to improve joining strength by melting of the first and second brazing rings.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, the present invention will be described with reference to the accompanying drawings.

When it is determined that a detailed description of the related art may unnecessarily obscure the subject matter of the present invention, the description thereof will be omitted. Further, the following terms, which are defined in consideration of functions of the present invention, may be altered depending on the user's intentions or judicial precedents. Therefore, the meaning of each term should be interpreted based on the entire disclosure of the specification.

Figure 1A:
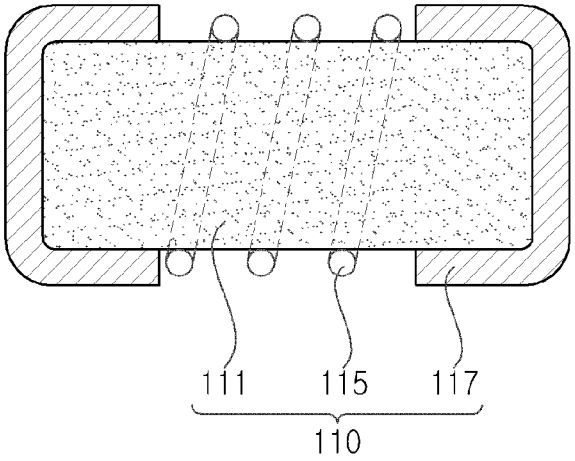
FIGS. 1A to 1C are sectional views illustrating fuse units according to the present invention.
Figure 1B:
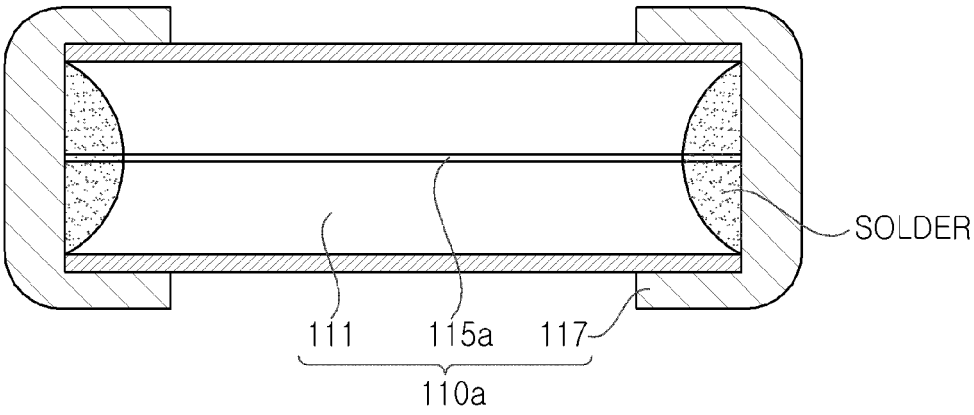
Figure 1C:
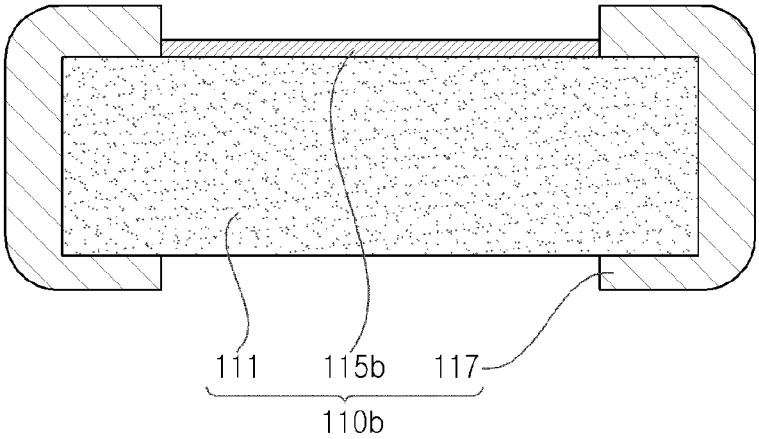
Figure 2:
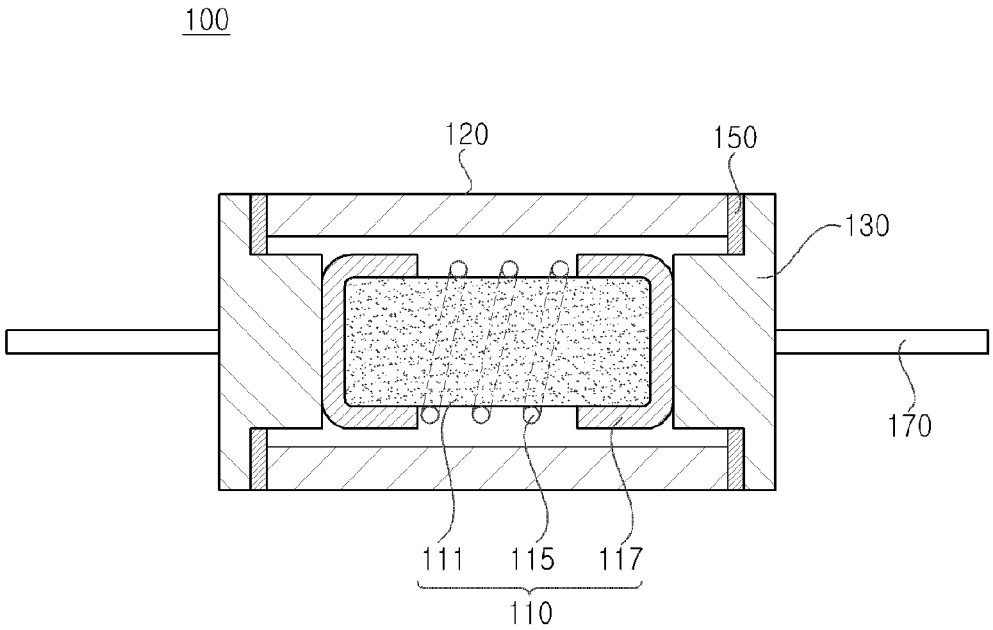
FIG. 2 is a sectional view illustrating a fuse according to a first embodiment of the present invention.
Figure 3:
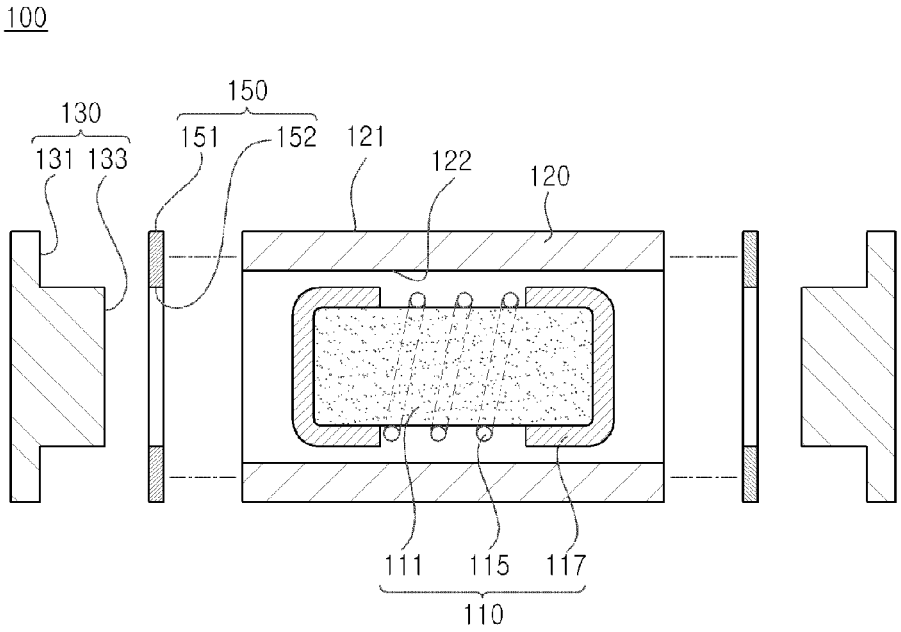
FIG. 3 is an exploded sectional view illustrating the fuse according to the first embodiment of the present invention.

FIGS. 1A to 1C are sectional views illustrating fuse units according to the present invention. FIG. 2 is a sectional view illustrating a fuse according to a first embodiment of the present invention. FIG. 3 is an exploded sectional view illustrating the fuse according to the first embodiment of the present invention.

As illustrated in FIGS. 1A to 3, a fuse 100 according to the present invention generally includes a ceramic tube 120, sealing electrodes 130, a fuse unit 110, and brazing rings 150.

Specifically, the fuse 100 according to the present invention includes a ceramic tube 120 filled with an inert gas, a pair of sealing electrodes 130, which are disposed at both ends of the ceramic tube 120 and respectively electrically connected to lead wires 170, a fuse unit 110, which is accommodated in the ceramic tube 120, is electrically connected to the sealing electrodes 130, and includes a fusible element 115, and brazing rings 150 which seal between the ceramic tube 120 and each of the sealing electrodes 130.

Referring to FIG. 1A, the fuse unit 110 according to the present invention may include a nonconductive member 111, terminal electrodes 117 disposed at both ends of the nonconductive member 111, and a fusible element 115 electrically connected to the terminal electrodes 117.

The nonconductive member 111 may have a rod shape and may be formed of a ceramic material such as alumina. In addition, the fusible element 115 may be attached to the outer circumferential surface of the nonconductive member 115.

The terminal electrodes 117 may be formed of a copper alloy and may be disposed at both ends of the nonconductive member 111 to electrically connect the sealing electrodes 130 with a fuse unit 110.

The fusible element 115 may be spirally wound on the outer circumferential surface of the nonconductive member 111. By forming the fusible element 115 to be longer than fusible elements 115*a* and 115*b* illustrated in FIGS. 1B and 1C and to be described later, time-lag characteristics by which the fuse 100 is not blown out by a surge voltage may be improved. Accordingly, the fuse 100 may be stably used at a high voltage, for example, at 250 V or higher.

The fusible element 115 is blown (cut off) when overcurrent is supplied thereto. In addition, for example, the fusible element 115 may be formed of copper (Cu), silver (Ag), an copper-silver alloy, a nickel-copper alloy, a nickel-iron alloy, copper surface-coated with silver, iron (Fe), chromium (Cr), and an iron-based alloy containing nickel as a main component.

In addition, referring to FIG. 1B, a fuse unit 110*a* according to the present invention includes a nonconductive member 111 having a hollow cylindrical shape, terminal electrodes 117 disposed at both ends of the nonconductive member 111, and a fusible element 115a electrically connected to the terminal electrodes 117 and penetrating the nonconductive member 111.

In addition, referring to FIG. 1C, a fuse unit 110*b* according to the present invention includes a nonconductive member 111, terminal electrodes 117 disposed at both ends of the nonconductive member 111, and a fusible element 115*b* attached to the outer circumferential surface of the nonconductive member 111 in the lengthwise direction to be electrically connected to the terminal electrodes 117.

As such, the fuse unit 110*a* according to the present invention may be formed in various shapes, taking into consideration use and characteristics of products.

The ceramic tube 120 according to the present invention has a cylindrical shape and is formed of a ceramic material. The cylindrical ceramic tube 120 is provided with sealing electrodes 130 at both ends thereof and is sealed by the sealing electrodes 130. In addition, both ends of the ceramic tube 120 are joined to the sealing electrodes 130 by brazing junctions.

The sealing electrodes 130 are installed at both ends of the ceramic tube 120 as described above to be respectively electrically connected to the lead wires 170.

In addition, for example, the sealing electrodes 130 may be formed of a copper alloy.

For example, each of the sealing electrodes 130 may include a contact portion 133 that protrudes toward the inside of the ceramic tube 120 to be inserted into the ceramic tube 120 and contact the fuse unit 110 and a junction portion 131 joined to the brazing ring 150.

Since the contact portion 133 of the sealing electrode 130 protrudes inward, the sealing electrode 130 may be efficiently assembled with the brazing ring 150 or the ceramic tube 120. Since the fuse unit 110 contained in the ceramic tube 120 may be pressed during a brazing process, electrical connection between the sealing electrode 130 and the contact portion 133 may be improved.

The brazing ring 150 according to the present invention, as a filler metal, is melted between the ceramic tube 120 and each of the sealing electrodes 130 which are base metals to join the ceramic tube 120 to the sealing electrodes 130 in a sealed state.

For example, the brazing ring 150 may be formed of an alloy including copper (Cu), silver (Ag), and zinc (Zn).

In addition, the brazing process is performed at a temperature higher than a melting point of the brazing ring 150, as a filler metal, and lower than melting points of the ceramic tube 120 and the sealing electrodes 130, as base metals.

Wetting properties that indicate the degree of affinity between a filler metal and a base metal are an important factor in a brazing junction. That is, when the brazing ring has poor wetting properties with the ceramic tube 120 and the sealing electrodes 130, a junction therebetween cannot be formed. Thus, according to the present invention, a ceramic material having excellent wetting properties with the filler metal is used to form the ceramic tube 120 that accommodates the fuse unit 110 instead of a glass material having poor wetting properties with the filler metal.

In addition, the brazing junction using the brazing ring 150 may provide high joining strength since the brazing ring 150 generates capillary action on the surfaces of the ceramic tube 120 and the sealing electrodes 130 while being melted and provides excellent resistance against impact such as vibration or the like.

Meanwhile, an outer surface 151 of the brazing ring 150 is disposed at the same level of an outer surface of the ceramic tube 120, and an inner surface 152 of the brazing ring 150 is disposed to extend toward the inside of the ceramic tube 120 to a portion farther inward than an inner edge of the ceramic tube 120.

As described above, the fuse 100 according to the present invention may have improved durability since the ceramic tube 120 formed of a ceramic material with excellent mechanical strength is used and the ceramic tube 120 is joined to each of the sealing electrodes 130 by use of the brazing rings 150, the fuse 100 may be stably used at a high voltage.

Figure 4:
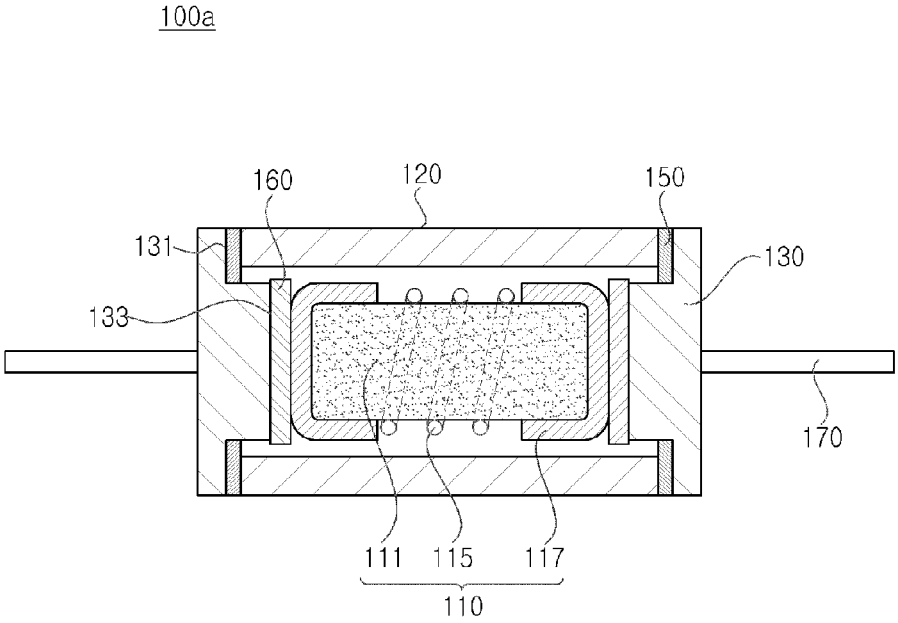
FIG. 4 is a sectional view illustrating a fuse according to a second embodiment of the present invention.

FIG. 4 is a sectional view illustrating a fuse 100*a* according to a second embodiment of the present invention.

Referring to FIG. 4, the fuse 100*a* according to the present invention may further include brazing members 160 that join each of the contact portions 133 to each of the terminal electrodes 117.

For example, the brazing member 160 may have a plate shape and may be formed of an alloy including copper (Cu), silver (Ag), and zinc (Zn).

The brazing member 160 is melted between the contact portion 133 and the terminal electrode 117 to join the contact portion 133 to the terminal electrode 117 in the same manner as the brazing ring 150.

Thus, the fuse unit 110 may be more firmly joined to the sealing electrodes 130 by use of the brazing members 160, thereby improving durability of the fuse 100*a*.

Figure 5:
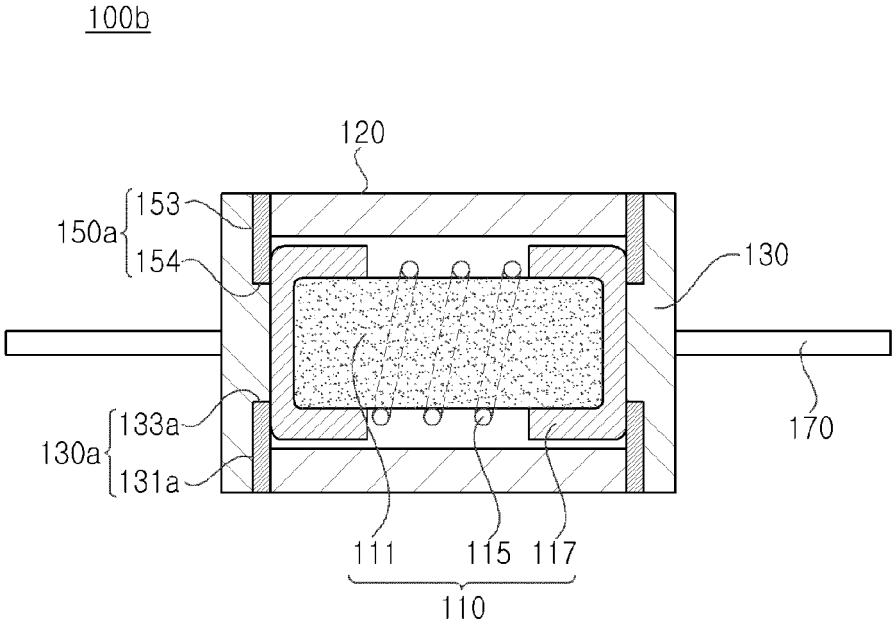
FIG. 5 is a sectional view illustrating a fuse according to a third embodiment of the present invention.

FIG. 5 is a sectional view illustrating a fuse 100*b* according to a third embodiment of the present invention.

Referring to FIG. 5, each of the brazing rings 150*a* of the fuse 100*b* according to the present invention may be configured to be joined to both of the ceramic tube 120 and the fuse unit 110.

That is, the brazing ring 150*a* may include an outer portion 153 that is joined to an end of the ceramic tube 120 and an inner portion 154 that is joined to an end portion of the fuse unit 110, particularly, the terminal electrode 117.

Thus, the brazing ring 150*a* may have a thickness identical to or greater than that of the contact portion 133*a*. This is because, when the thickness of the brazing ring 150*a* is greater than that of the contact portion 133*a*, the brazing ring 150*a* may be joined to both the ceramic tube 120 and the terminal electrode 117 after being melted.

In addition, the inner portion 154 of the brazing ring 150*a* may be formed to extend inward to a portion farther inward than that of the brazing ring 150 of FIG. 2, and the contact portion 133*a* may have a narrower width than the contact portion 133 of FIG. 2.

Figure 6:
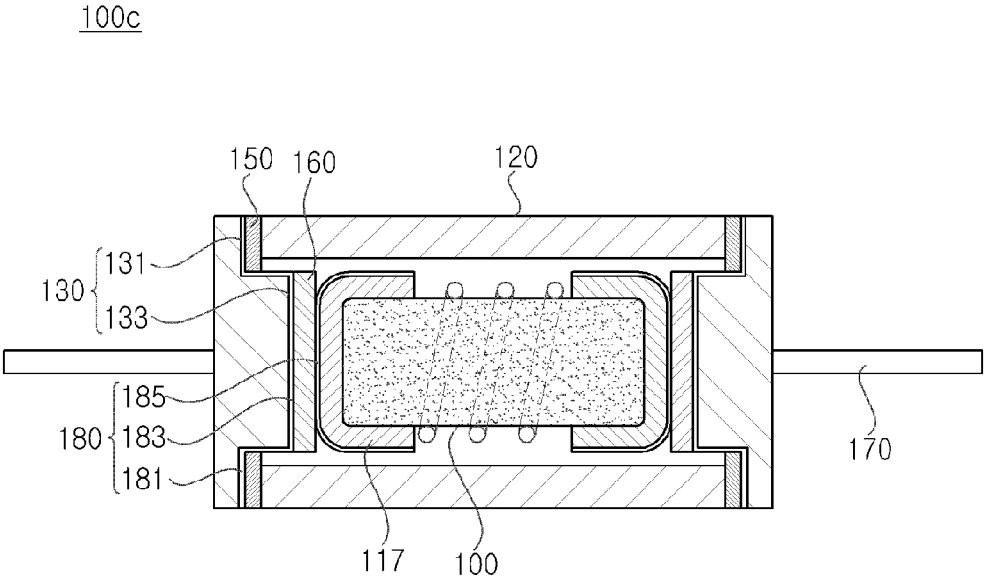
FIG. 6 is a sectional view illustrating a fuse according to a fourth embodiment of the present invention.

FIG. 6 is a sectional view illustrating a fuse 100*c* according to a fourth embodiment of the present invention.

Referring to FIG. 6, the fuse 100*c* according to the present invention may further include a plating layer 180 in order to improve wetting properties of the brazing ring 150 or the brazing member 160 with base metals.

In particular, the plating layer 180 (181,183, and 185) is formed on at least one of the contact portion 133, the junction portion 131, and the terminal electrode 117 to improve joining strength of the brazing ring 150 or the brazing member 160 by a melting process.

In addition, the plating layer 180 may include nickel (Ni) or titanium (Ti), and may be formed of, for example, a compound such as $Ni_3P$.

Figure 7A:
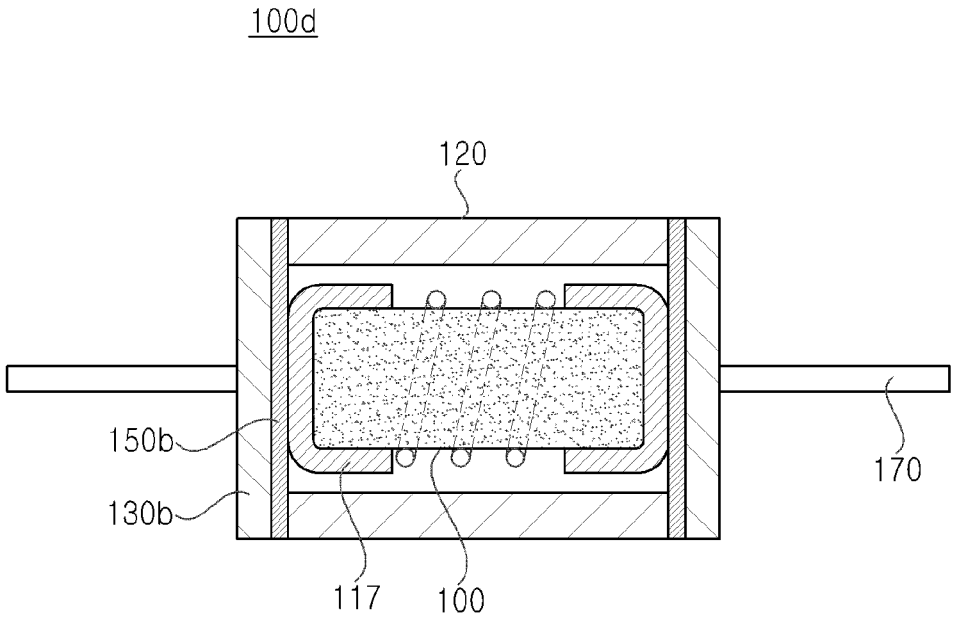
FIGS. 7A and 7B are sectional views illustrating a fuse according to a fifth embodiment of the present invention.
Figure 7B:
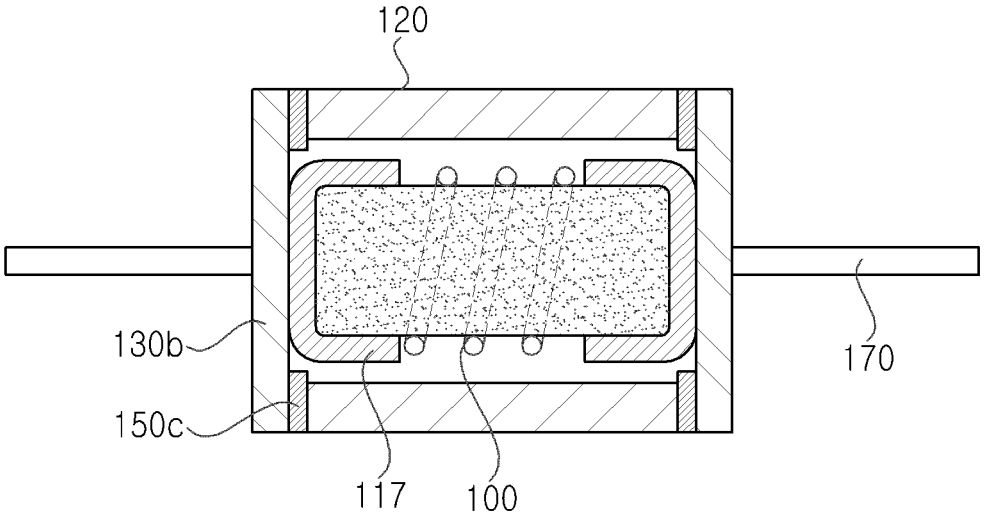

FIGS. 7A and 7B are sectional views illustrating a fuse 100d according to a fifth embodiment of the present invention.

Referring to FIGS. 7A and 7B, each of the sealing electrodes 130*b* according to the present invention may have a flat panel shape without having a protruding contact portion, which is different from the sealing electrodes illustrated in FIGS. 1 to 6.

In addition, a brazing ring 150*b* may have a flat panel shape so as to be joined to one end of the ceramic tube 120 and one terminal electrode 117 at the same time (FIG. 7A).

In addition, a brazing ring 150*c* may have a hollow ring shape such that the sealing electrode 130*b* directly contacts the terminal electrode 117 (FIG. 7B).

Hereinafter, a method of manufacturing a fuse according to the present invention will be described in detail.

FIGS. 8A to 8F are sectional views for describing a method of manufacturing a fuse 100 according an embodiment of the present invention.

As described above, the fuse 100 manufactured by the method according to the present invention may include a ceramic tube 120 in which a fuse unit 110 is accommodated, first and second sealing electrodes 130 and 135 respectively inserted into both ends of the ceramic tube 120 to be connected to the fuse unit 110, and first and second brazing rings 150 and 155 respectively joining the ceramic tube 120 to each of the first and second sealing electrodes 130 and 135.

Figure 8A:
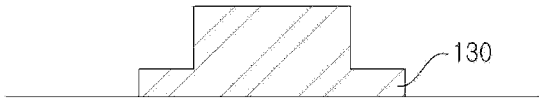
FIGS. 8A to 8F are sectional views for describing a method of manufacturing a fuse according an embodiment of the present invention.

First, referring to FIG. 8A, the first sealing electrode 130 is formed in operation S1. The first sealing electrode 130 includes a contact portion 133 that protrudes toward the inside of the ceramic tube 120 to be inserted into the ceramic tube 120 and contact the fuse unit 110 and a junction portion 131 joined to the first brazing ring 150.

Figure 8B:
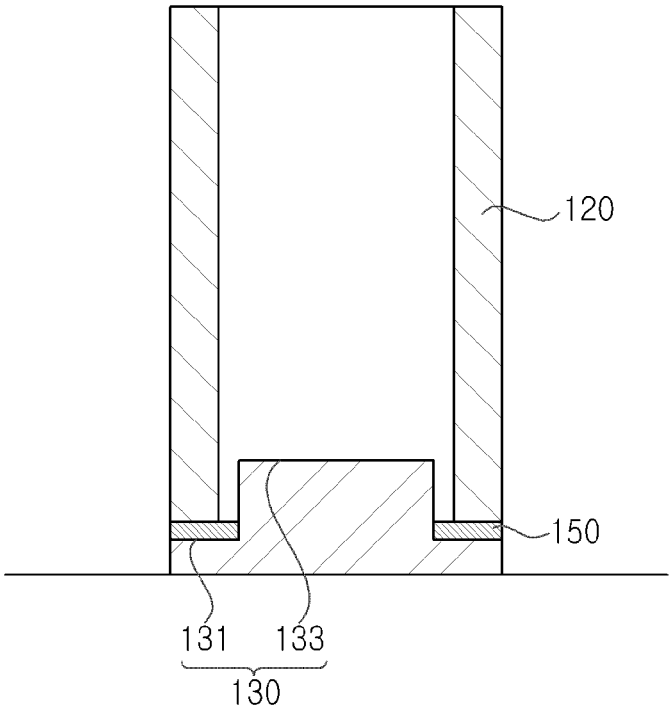

Then, referring to FIG. 8B, the first brazing ring 150 and the ceramic tube 120 are sequentially stacked on the first sealing electrode 130 in operation S2.

The first brazing ring 150 is mounted on the junction portion 131 of the first sealing electrode 130, and the ceramic tube 120 is disposed on the first brazing ring 150.

Figure 8C:
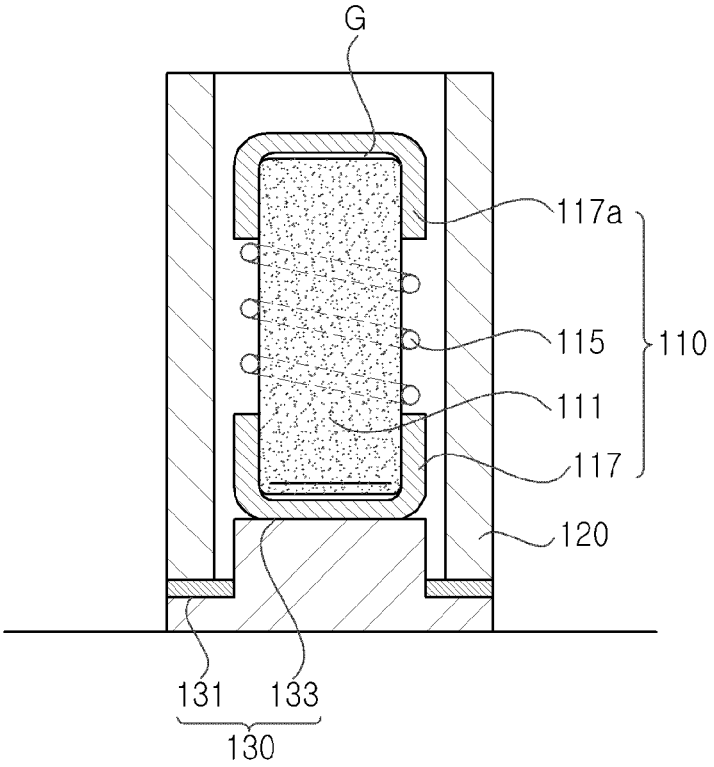

Then, referring to FIG. 8C, the fuse unit 110 is inserted into the ceramic tube 120 in operation S3.

In this regard, the fuse unit 110 may include a nonconductive member 111, first and second terminal electrodes 117 and 117*a* disposed at both ends of the nonconductive member 111, and a fusible element 115 electrically connected to the first and second terminal electrodes 117 and 117*a*.

The first terminal electrode 117 of the inserted fuse unit 110 is disposed on an upper surface of the contact portion 133 of the first sealing electrode 130. A gap G or space may be formed between an inner surface of the first terminal electrode 117 and the nonconductive member 111. The gap G or space may be eliminated by pressure applied thereto when the second sealing electrode 135 is joined thereto which will be described later and by a brazing process described in operation S5. The gap G or space may be naturally or artificially formed during assembly of the fuse unit 110.

Figure 8D:
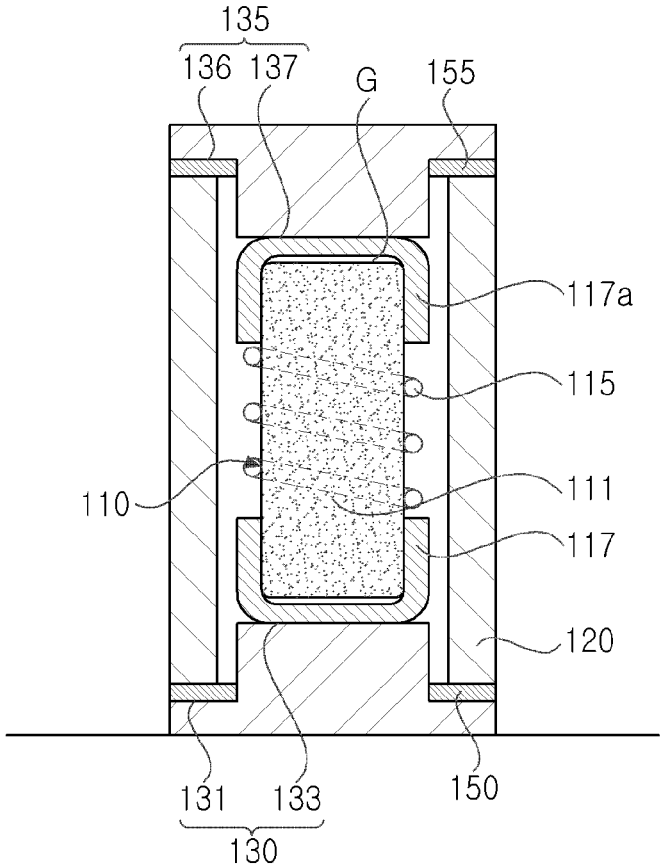

Then, referring to FIG. 8D, the second brazing ring 155 and the second sealing electrode 135 are sequentially stacked on the ceramic tube 120 in operation S4.

The fuse 100 is assembled through operation S1 to operation S4 to be a state before the brazing junction.

Then, the fuse 100 that has undergone operation S1 to operation S4 is placed in a chamber C, and the ceramic tube 120 and each of the first and second sealing electrodes 130 and 135 are sealed by melting the first and second brazing rings 150 and 155 in operation S5.

Operation S5 may be performed in the chamber C under an inert gas atmosphere, and the inside of the sealed ceramic tube 120 is filled with an inert gas. In addition, the inert gas functions to prevent oxidation of the fuse unit 110 and improve durability.

Figure 8E:
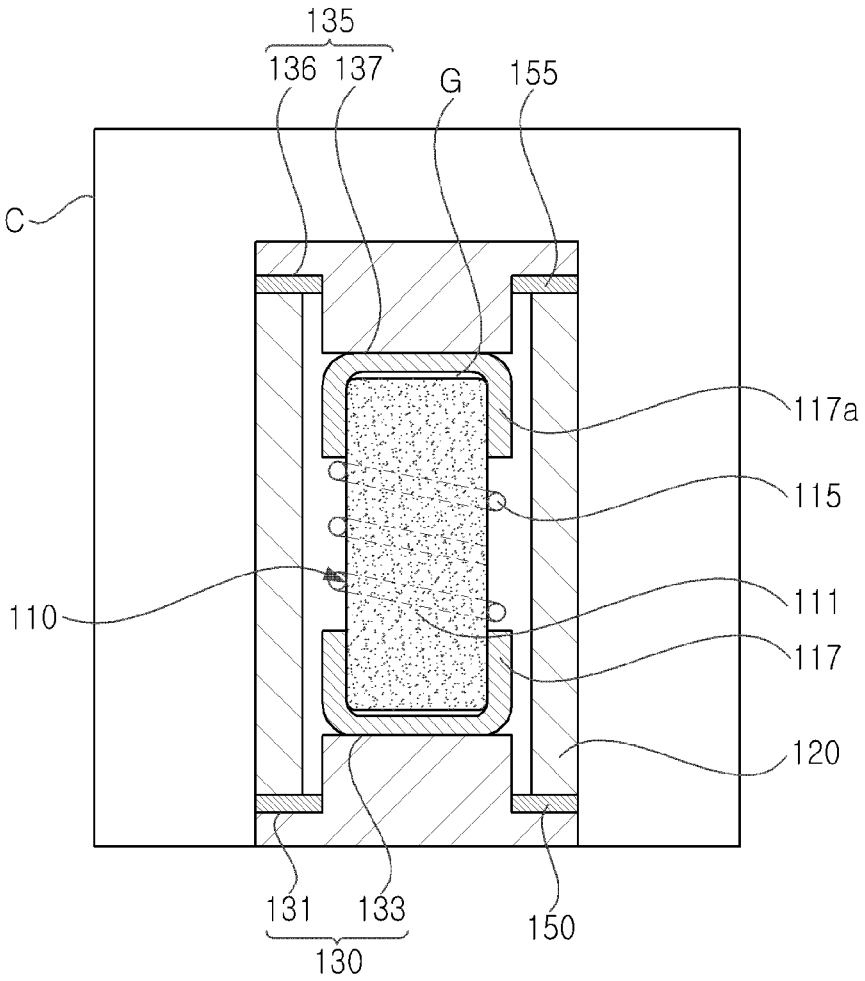
Figure 8F:
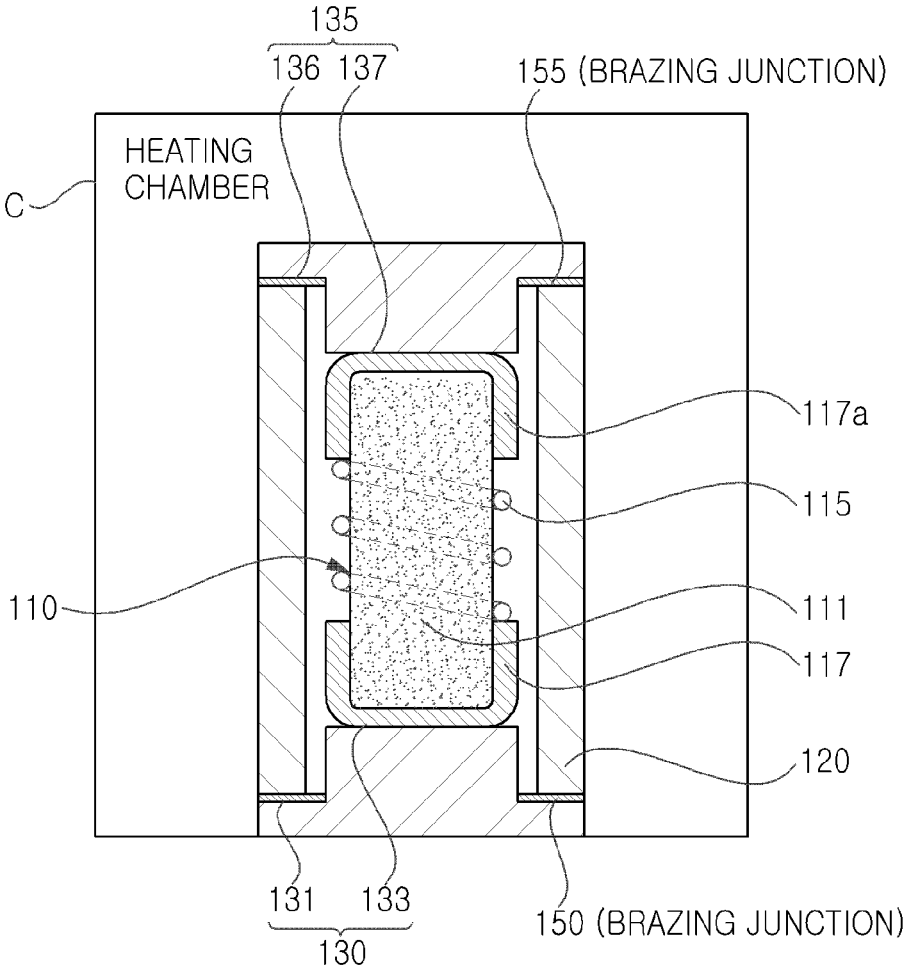

The fuse 100 is vertically added to the chamber C in a longitudinal direction (FIG. 8E). The chamber C is heated to melt the first and second brazing rings 150 and 155, thereby completing junction (FIG. 8F).

In this regard, the chamber C is heated to a temperature less than melting points of the first and second sealing electrodes 130 and 135 and the ceramic tube 120 which are base metals in order to prevent deformation of the base metals. The heating temperature may be adjusted in the range of 500 to 850 according to the material of the first and second brazing rings 150 and 155. For example, when the first and second brazing rings 150 and 155 are formed of an alloy including copper (Cu) and silver (Ag), e.g., $Ag_{25}Cu$, the chamber C may be heated at a temperature of 800 to 850. In this regard, the fusible element 115 may be formed of a material that is not blown after brazing, for example, a nickel-copper alloy and a nickel-iron alloy.

In addition, when the first and second brazing rings 150 and 155 are formed of an alloy including silver (Ag), copper (Cu), zinc (Zn), and tin (Sn), e.g., $Ag_{56}CuZnSn$, the brazing is performed at a temperature of 600 to 650° C. Thus, the fusible element 115 may be also formed of copper (Cu), silver (Ag), and a silver-copper alloy which are blown at a temperature of 800 to 850° C. as well as the nickel-copper alloy and the nickel-iron alloy.

That is, by reducing the brazing temperature where the first and second brazing rings 150 and 155 are melted from the range of 800 to 850° C. to the range of 600 to 650° C., main components of conventional fusible elements such as copper (Cu), silver (Ag), a silver-copper alloy, and the like may be used. Accordingly, there is a wide range of choices in designing fuses. In addition, at a temperature of 800° C. or greater, the fusible element 115 may be deteriorated by heat even though it is not blown out. However, when the brazing process is performed at a relatively lower temperature of 600 to 650° C., degradation of performance and quality by heat may be reduced.

Then, the heated first and second brazing rings 150 and 155 are melted to join the surfaces of the base metals in a sealed state through capillary action, thereby decreasing in thickness. Then, lead wires are connected to outer surfaces of the sealing electrodes, thereby completing manufacture of the fuse 100.

Figure 9:
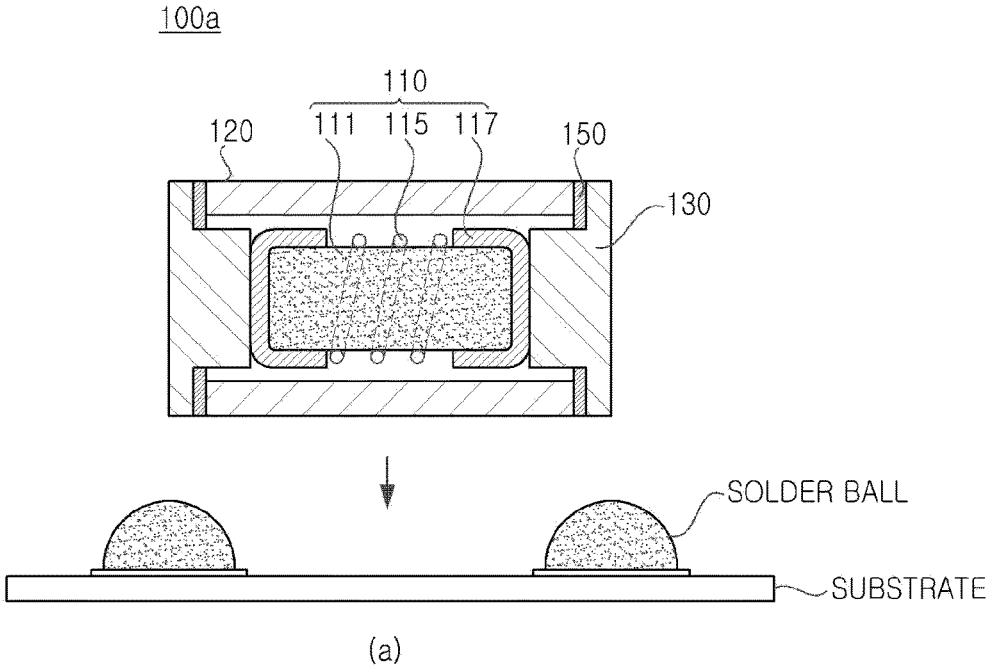
FIG. 9 is a sectional view illustrating a fuse according to the present invention mounted on a surface of a substrate.
Figure 9:
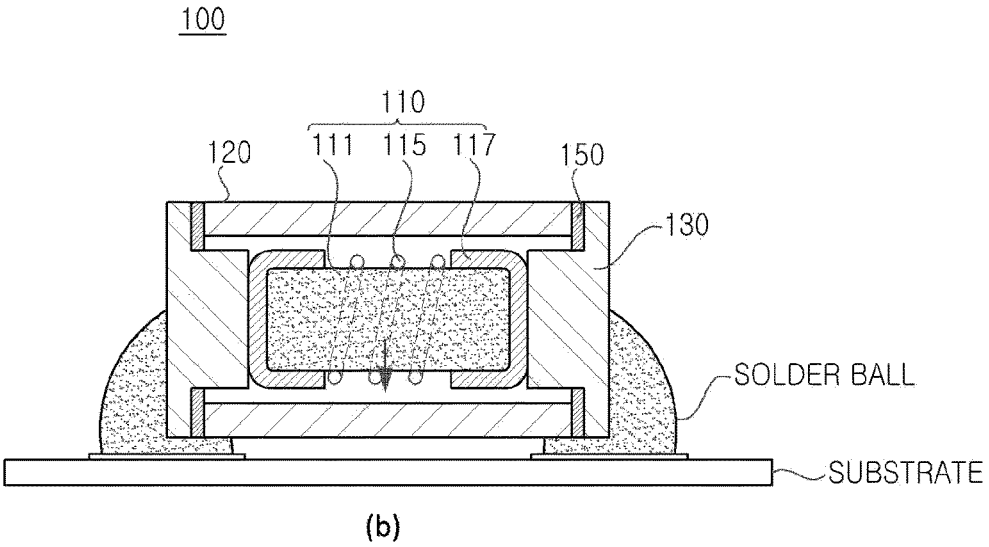

Meanwhile, FIG. 9 is a sectional view illustrating a fuse 100*a* according to the present invention mounted on a surface of a substrate.

Referring to FIG. 9, lead wires may be omitted, and the sealing electrodes 130 may be joined to solder balls in the fuse 100*a* according to the present invention. Thus, the fuse 100*a* may be used as a surface mount device (SMD).

As described above, according to the method of manufacturing the fuse according to the present invention, the ceramic tube formed of a ceramic material with excellent mechanical strength is used, and the ceramic tube is joined to the sealing electrodes by use of the brazing rings, and thus joining strength and durability of the fuse are improved.

In addition, by winding the fusible element on the outer circumferential surface of the nonconductive member, time-lag characteristics may be improved, so that the fuse may be stably used at a high voltage.

In addition, by reducing the temperature of the brazing process to the range of 600 to 650° C., the fusible element is not blown out even though conventional materials therefor are used.

As described above, according to the method of manufacturing the fuse according to the present invention, a fuse having improved durability and stably used at a high voltage of 250 V or greater may be manufactured through the brazing process.

As is apparent from the above description, according to the fuse and the manufacturing method thereof according to the present invention, the nonconductive member formed of a ceramic material with excellent mechanical strength and the ceramic tube are used, and the ceramic tube is joined to each of the sealing electrodes by use of the brazing rings, and thus durability of the fuse is improved.

In addition, according to the fuse and the manufacturing method thereof according to the present invention, since the fusible element is wound on the outer circumferential surface of the nonconductive member to have sufficient length and a sufficient number of turns, time-lag characteristics may be improved, and thus the fuse may be stably used at a high voltage.

Furthermore, according to the fuse and the manufacturing method thereof according to the present invention, as a plating layer is formed at brazing junction regions, wetting properties and joining strength may further be improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fuse comprising:

a ceramic tube;

a pair of sealing electrodes disposed at both ends of the ceramic tube and respectively electrically connected to lead wires;

a fuse unit accommodated in the ceramic tube to be electrically connected to the sealing electrodes and comprising a nonconductive member, terminal electrodes disposed at both ends of the nonconductive member, and a fusible element electrically connected to the terminal electrodes; and brazing rings sealing between the ceramic tube and each of the sealing electrodes, wherein the ceramic tube is joined to the sealing electrodes by melting of the brazing rings.

2. The fuse according to claim 1, wherein:

the nonconductive member has a rod shape and is formed of a ceramic material; and the fusible element is wound on the outer circumferential surface of the nonconductive member.

3. The fuse according to claim 1, wherein the brazing ring comprises an alloy comprising copper (Cu), silver (Ag), and zinc (Zn).

4. The fuse according to claim 1, wherein each of the sealing electrodes comprises a contact portion protruding toward the inside of the ceramic tube to be inserted into the ceramic tube and contact the fuse unit and a junction portion joined to the brazing ring.

5. The fuse according to claim 4, wherein an outer surface of the brazing ring is disposed at the same level of an outer surface of the ceramic tube, and an inner surface of the brazing ring is disposed to extend toward the inside of the ceramic tube to a portion farther inward than an inner edge of the ceramic tube.

6. The fuse according to claim 5, wherein the brazing ring comprises an outer portion joined to the ceramic tube and an inner portion joined to an end portion of the fuse unit.

7. The fuse according to claim 4, further comprising brazing members melted between the contact portion and each of the terminal electrodes to join the contact portion to the terminal electrode.

8. The fuse according to claim 7, further comprising a plating layer comprising nickel (Ni) or titanium (Ti) disposed on at least one of the contact portion, the junction portion, and the terminal electrode to improve joining strength by melting of the brazing ring or the brazing member.

9. The fuse according to claim 1, wherein a space between the sealed ceramic tube and the fuse unit is filled with an inert gas.

10. A method of manufacturing a fuse comprising a ceramic tube accommodating a fuse unit, first and second sealing electrodes disposed at both ends of the ceramic tube to be connected to the fuse unit, and first and second brazing rings sealing between the ceramic tube and each of the sealing electrodes, the method comprising:

preparing the first sealing electrode;

sequentially stacking the first brazing ring and the ceramic tube on the first sealing electrode;

inserting the fuse unit into the ceramic tube;

sequentially stacking the second brazing ring and the second sealing electrode on the ceramic tube; and sealing between the ceramic tube and each of the first and second sealing electrodes by placing the resultant structure in a chamber and melting the first and second brazing rings.

11. The method according to claim 10, wherein:

each of the first and second sealing electrodes comprises a contact portion protruding toward the inside of the ceramic tube to be inserted into the ceramic tube and contact the fuse unit and a junction portion joined to each of the first and second brazing rings; and each of the first and second brazing rings is inserted to the junction portion of each of the first and second sealing electrodes.

12. The method according to claim 10, wherein:

the first and second brazing rings are formed of $Ag_{25}CuZnSn$, an alloy comprising silver (Ag), copper (Cu), zinc (Zn), and tin (Sn); and the sealing is performed by melting the first and second brazing rings at a temperature of 500 to 850° C.

13. The method according to claim 11, wherein a plating layer comprising nickel (Ni) or titanium (Ti) is further disposed on the surface of the junction portion to improve joining strength by melting of the first and second brazing rings.

* * * * *